US005195353A

United States Patent [19]

Erbrick et al.

[11] Patent Number: 5,195,353

[45] Date of Patent: Mar. 23, 1993

[54] TOOLS FOR CRIMPING TUBULAR ELEMENTS ON WIRE OR CABLING

[75] Inventors: Robert S. Erbrick, Danboro; Joseph E. Erbrick, Jr., Chalfont, both of Pa.

[73] Assignee: Electroline Corp., Danboro, Pa.

[21] Appl. No.: 864,162

[22] Filed: Apr. 2, 1992

Related U.S. Application Data

[63] Continuation of Ser. No. 718,057, Jun. 20, 1991, abandoned.

[51] Int. Cl.[5] ..... H01R 43/042

[52] U.S. Cl. ..... 72/410; 72/35; 29/751; 81/309

[58] Field of Search ..... 72/410, 409, 453.16, 72/35; 29/751, 753; 81/309, 307, 308

[56] References Cited

U.S. PATENT DOCUMENTS

| | | | |
|---|---|---|---|
| 510,897 | 12/1893 | Crook | 81/309 |
| 1,250,690 | 12/1917 | Stallings . | |
| 1,413,453 | 4/1922 | Brassell . | |
| 1,498,488 | 6/1924 | Stallings . | |
| 2,086,400 | 7/1937 | Brenizer . | |
| 2,216,152 | 10/1940 | Becker | 72/35 |
| 2,415,896 | 2/1947 | Marsh | 72/409 |
| 2,787,925 | 4/1957 | Buchanan et al. . | |
| 3,120,772 | 2/1964 | Mixon | 72/410 |
| 3,216,291 | 11/1965 | Madeira . | |
| 3,257,874 | 6/1966 | Madeira . | |
| 3,263,535 | 8/1966 | Zurcher . | |
| 3,330,148 | 7/1967 | Hornung | 72/410 |
| 3,688,553 | 9/1972 | Demler | 72/410 |
| 4,136,549 | 1/1979 | Lytle et al. | 72/410 |
| 4,480,460 | 11/1984 | Bush et al. | 72/410 |
| 4,934,172 | 6/1990 | Bush | 72/410 |

OTHER PUBLICATIONS

Rota-Crimp catalog page, "Heavy Duty Bantam Rota-Crimp tool for Heavy Duty Solistrand terminals" and Rota-Crimp tool for Uninsulated terminals and splices for 8-4/0 AWG wire sizes.

Burndy catalog Section B, p. 80, "Type My Dieless Hytool".

Burndy catalog Section H, p. 94, "Type OH25 Hytool One-Hand Operation, Dieless, Full Cycle Ratchet Tool".

Thomas & Betts catalog p. C 96, "Smart® Universal Die 12 Ton Hydraulic Head".

*Primary Examiner*—Daniel C. Crane

*Attorney, Agent, or Firm*—Panitch Schwarze Jacobs & Nadel

[57] ABSTRACT

A crimping tool according to the present invention has a head pivotally coupled with a pair of elongated handles. The head includes a pair of jaw members, mounted on separate pivots between a pair of jaw links, with opposing first and second planar crimping surfaces which, when brought together, abut and form sides of an included angle. A movable die member having a relatively elongated third planar crimping surface lies between the jaws and the first and second crimping surfaces to define with those surfaces a triangular crimping nest. The movable die member is adjustably mounted to the pair of jaw links for continuously adjustable positioning of the third crimping surface with respect to the first and second crimping surfaces and continuous adjustment of crimp nest size.

19 Claims, 2 Drawing Sheets

TOOLS FOR CRIMPING TUBULAR ELEMENTS ON WIRE OR CABLING

This application is a continuation of U.S. patent application Ser. No. 07/718,057 filed Jun. 20, 1991, now abandoned.

BACKGROUND OF THE INVENTION

Various tools for crimping tubular connector elements or "sleeves" and tubular terminal elements onto wires and the like are known. Typically, such tools have two or more jaws or comparable members coupled together in some way for movement with respect to one another. The members define a crimp nest in which the tubular element is received and crimped.

Crimping tools may generally be characterized as being either of two types: symmetric or indent.

A symmetric crimp tool typically has a set of jaws configured to provide a crimp nest which is at least generally symmetric, for example circular, square, hexagonal, etc. Interchangeable dies or, in at least one instance, a pair of rotating dies are sometimes provided in symmetric crimp tools to vary the crimping surfaces so as to define crimp nests of varying sizes. While specific manufacturers typically offer crimpable tubular elements in standard sizes, these sizes vary from manufacturer to manufacturer. Unless a sufficiently large number of different rotatable or interchangeable dies or different crimping surfaces are provided to incrementally vary the crimp nest size, some overcrimping or undercrimping may occur, depending upon tubular element/wire combinations being crimped. Tools with rotatable dies can provide only a limited number of discrete crimp nest sizes. While theoretically an endless number of crimp nest sizes can be provided with interchangeable dies, there is a manufacturing cost associated with providing each additional die.

Indentor-type crimping tools are characterized as having one or more generally convex crimping surfaces (indentor surfaces) which form a concavity at some point in the crimp. One advantage typically shared by indentor-type tools is that the one or at least one of the convex or indentor surfaces provided on a member is adjustably mounted to vary the degree of indentation thereby effectively varying crimp nest size. One problem which is associated with such tools is that the pressure generated by the tool is concentrated at the peak of each convex indentor surface. This may overstress the tubular element being crimped, causing the element to fracture or tear. Another problem which some users perceive is that the crimp produced by such tools may be weaker than symmetric crimps.

SUMMARY OF THE INVENTION

In one aspect, the invention is a tool for crimping tubular connector and terminal elements which comprises: a first jaw member having a pair of opposing ends and a first crimping surface proximal a first of the pair of ends; a second jaw member having a pair of opposing ends and a second crimping surface proximal a first of the pair of ends; pivot means supporting the first and second jaw members for pivoting movement with respect to one another, an end of the first crimping surface at least adjoining an end of the second crimping surface and defining a generally concave recess when the first ends of the first and second jaws are pivoted together; a third generally planar crimping surface located between the first ends of the first and second jaw members, the third surface facing and defining a crimp nest with the first and second crimping surfaces, and means for adjustably moving the third crimping surface towards and away from the adjoining ends of the first and second crimping surfaces to vary the size of the crimp nest defined when the first ends of the first and second jaw members are pivoted together.

In another aspect, the invention is a tool for crimping tubular connector and terminal elements which comprises: a first jaw member having a pair of opposing ends and a first, generally planar crimping surface proximal a first of the pair of ends; a second jaw member having a pair of opposing ends and a second, generally planar crimping surface proximal a first of the pair of ends; pivot means supporting the first and second jaw members for pivoting movement with respect to one another, the first and second crimping surfaces defining two sides of an included angle when the first ends of the first and second jaws are pivoted together; and a third, generally planar crimping surface supported from the pivot means to lie generally between the first and second crimping surfaces and define a generally triangular crimp nest with the first and second crimping surfaces.

BRIEF DESCRIPTION OF THE DRAWINGS

The foregoing summary, as well as the following detailed description of preferred embodiments of the invention will be better understood when read in conjunction with the appended drawings. For the purpose of illustrating the invention, there is shown in the drawings, an embodiment which is presently preferred. It should be understood, however, that the invention is not limited to the precise arrangements and instrumentalities shown. In the drawings.

DETAILED DESCRIPTION OF THE PREFERRED EMBODIMENTS

Figure 1:
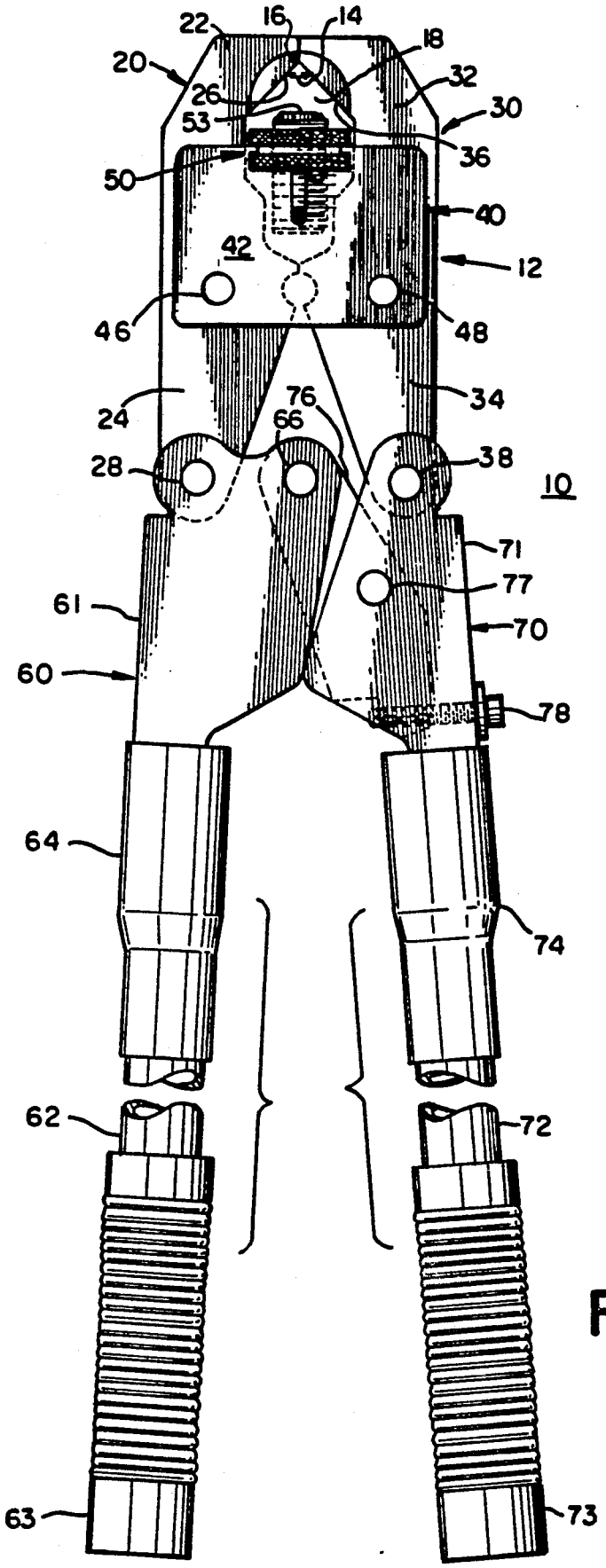
FIG. 1 depicts diagrammatically in a closed configuration a preferred crimping hand tool of the present invention.

Referring to the drawings wherein like numerals are used to indicate the same elements throughout, there is shown in the figures a preferred embodiment of a hand operated crimping tool indicated generally at 10. The major elements of the tool 10 are the head, indicated generally at 12, and a pair of handles indicated generally at 60 and 70, respectively. The head 12 includes first and second jaw members 20 and 30, respectively, a jaw link assembly, indicated generally at 40, and an adjustable crimping die assembly, indicated generally at 50.

First and second jaw members 20 and 30 are preferably mirror images of one another. The first jaw member 20 has a pair of opposing ends 22 and 24 respectively. The opposing ends of the second jaw member 30 are indicated at 32 and 34, respectively.

Figure 2:
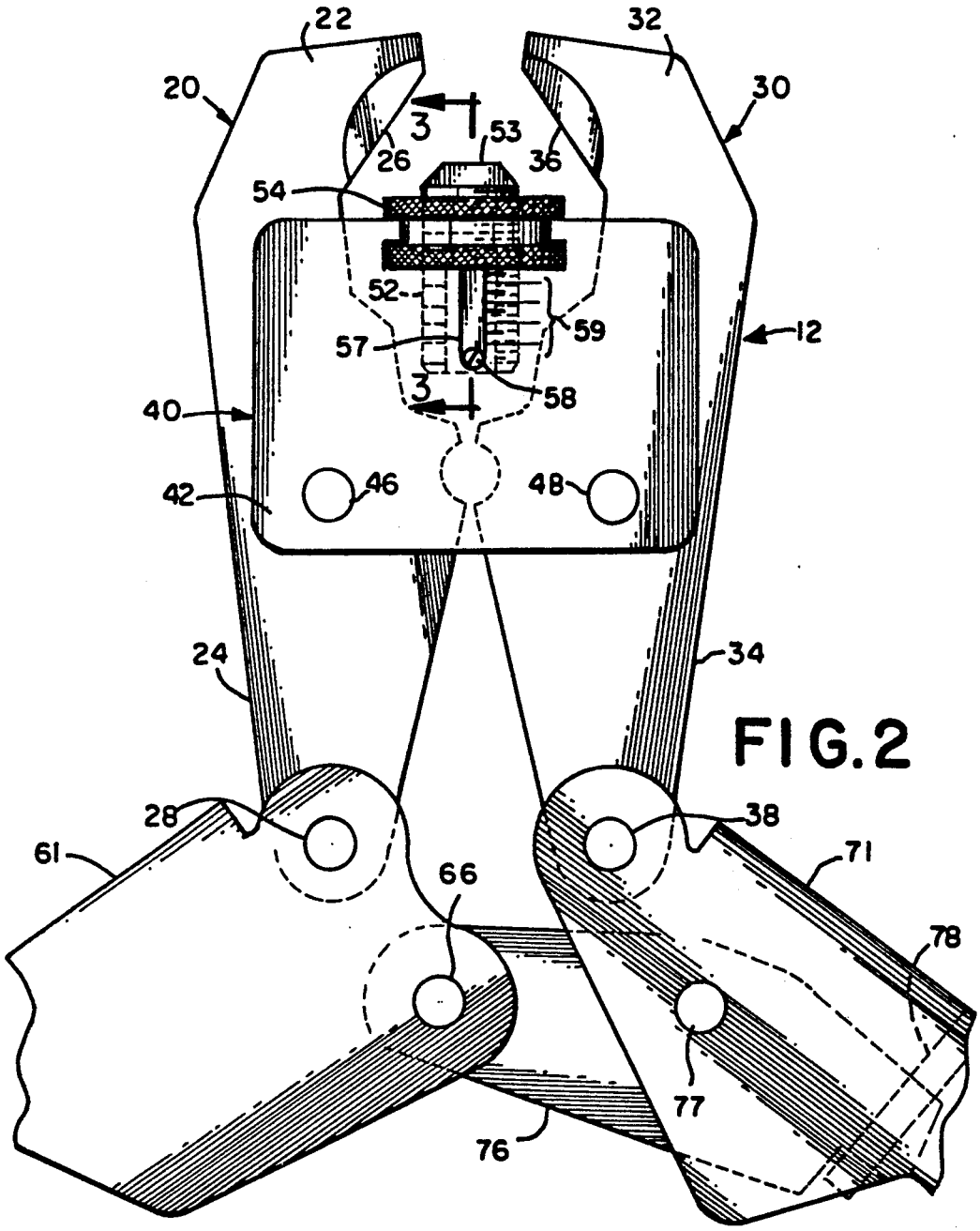
FIG. 2 depicts diagrammatically the head of the tool of FIG. 1, in an open configuration.

Referring to FIG. 2, the first jaw member 20 includes a first, at least generally planar crimping surface 26 proximal its first end 22. The second jaw member 30 also includes a second, mirror crimping surface 36 proximal its first end 32.

The jaw link assembly 40 constitutes a preferred means supporting the first and second jaw members 20 and 30 for pivoting movement with respect to one another. When the first ends 22 and 32 of the first and second jaws 20 and 30 are pivoted together, as indicated in FIG. 1, an end of the first crimping surface 26 at least adjoins and preferably abuts an end of the second crimping surface 36. The surfaces 26 and 36 should at least define a concave recess open on opposing sides of a common plane of the tool parallel to the planes of FIGS. 1 and 2 and defined by the first and second crimp surfaces pivoting with the pivoting first and second members 20 and 30, and preferably define two sides of an included angle 14 having an apex at 16, as indicated and a close ended concave recess.

Figure 3:
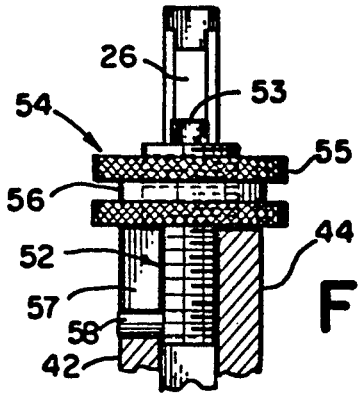
FIG. 3 is a cross section through a bridge portion of the head of FIG. 2 taken through the jaw links of the tool along the lines 3—3 in FIG. 2.

The assembly 40 preferably includes a first jaw link 42 preferably provided by a generally rectangular plate and a second, preferably similar jaw link 44 seen in FIG. 3. First and second pivots are provided at 46 and 48, respectively, preferably by bolts passed through coaxial bores provided in each of the jaw links 42 and 44 and in each of the first and second jaw members 20 and 30, respectively. The jaw links 42 and 44 and the bolts constituting pivots 46 and 48 are secured together by nuts (not depicted) received on the threaded ends of the bolts on the side of the tool 10 hidden from view in FIGS. 1 and 2. Pivots 46 and 48 support each of the first and second jaw members 20 and 30, respectively, for pivoting movement with respect to one another.

While the jaw link assembly 40 is preferred, the pivot means of the present invention may be implemented in other ways. In less preferred alternatives, for example, a single jaw link might be used in place of the indicated pair of jaw links, rivets pivots 46 and 48 or the pivot means might constitute a single pivot supporting each of a pair of jaw members, which would be overlapped in a crossing fashion in a scissors- or pliers-like configuration. By way of further clarification of the terms being used in this description, the opposing ends 22/24 and 32/34 of each of the first and second jaw members 20 and 30 extend away from the pivots 46 and 48, respectively.

First and second elongated handles 60 and 70 provide sufficient leverage for hand-operation of the head 12. Each handle preferably comprises a U-shaped member or "shroud" 61 and 71, respectively, a circular tubular member 62 and 72, respectively, and a hand grip 63 and 73, respectively, mounted to each member 62 and 72. A tubular connector 64 is fixedly coupled by suitable means such as stamping or crimping to adjoining ends of shroud 61 and tubular member 62. A similar connector 74 is provided in a similar fashion in the second elongated handle 70. Shroud 61 is generally symmetrical with respect to the plane of FIGS. 1 and 2. Shroud 61 receives in the space provided between its opposing sides, the remaining end 24 of the first jaw member 20. A third pivot 28 is provided pivotally coupling together the shroud 61, constituting one proximal end of the first elongated handle 60, and the remaining end 24 of the first jaw member 20. The pivot 28 is again preferably provided by a bolt passed through concentric bores in opposing sides of the shroud 61 and the end 24 of the first jaw member 20 and again is held together with a nut (not depicted). A fourth pivot 38 is similarly provided pivotally coupling together shroud 71, forming the proximal end of the second handle 70, and the remaining end 34 of the second jaw 30 in an identical manner.

A lever arm 76 is pivotally coupled together with the first handle 60 by a fifth pivot indicated at 66. The lever arm 76 is itself pivotally coupled together with the second shroud 71 by a sixth pivot indicated at 77. Fifth and sixth pivots 66 and 77 can be provided by rivets, bolts or the like. A remaining end of the lever arm 76, on a side of the sixth pivot 77 opposite the fifth pivot 66, receives an adjustment screw 78 passed through the center line of the shroud 71. The screw 78 permits adjustment of the angle of the lever arm 76 with respect to the shroud 71 and of an over-center locking action of the handles 60 and 70 in the closed position, which is depicted in FIG. 1. This permits adjustment of the maximum crimping force which can be generated through the jaw members 20 and 30.

As is best seen in FIGS. 2 and 3, the adjustable crimping die assembly 5 is preferably provided by two major components, a movable die member 52 and an adjustment nut 54. The movable die member 52 is provided at one end with a third crimping surface 53 which is located between the first ends 22 and 32 of the jaw members 20 and 30 and between the first and second crimping surfaces 26 and 36. The movable die member 52 is preferably threaded along most or all of its length. Adjustment nut 54 is threaded to receive the movable die member 52. As can be seen in the various figures, the adjustment nut 54 has a knurled circumferential surface 55 which is provided with a central circumferential groove 56. As is best seen in FIG. 2, jaw link 42 is provided with a cutout to receive a lower portion of the adjustment nut 54 and a pair of ears which are received within the central groove 56. The second jaw link 44 includes a similar cutout. The two jaw links 42 and 44 together rotatably retain the crimping die assembly 50 in the tool head 12 means of the ears received in groove 56.

Jaw link 42 is further preferably provided with a central vertical slot 57 which receives a pin 58 staked to the movable die member 52. Pin 58 functions as an indicator means which is coupled through the body of the movable die member 52 with the third crimping surface 53 for moving with movement of the third crimping surface 53 towards and away from the apex 16 of the angle 14 (see FIG. 1). The position of the movable die member 52 is continuously adjustable over a range approximately equal to the threaded length of the movable die member 52 for providing continuously variable positioning of the third crimping surface 53 with respect to the first and second crimping surfaces 26 and 36 and the apex 16.

Preferably, at least one scale 59 is provided on an outer surface of jaw link 42 adjoining the vertical slot 57 for measuring the relative position of the third crimping surface with pin 58. The scale 59 can be simply a range of English or metric length measurements or can be keyed to suggested height(s) of the movable die member 52 and third crimping surface 53 for use of the tool 10 with respect to particular types of connectors, for the example, known connectors of particular manufacturers. If desired, two scales can be provided, one on either side of slot 57. Furthermore, if desired, a second slot can be provided in the second jaw link 44, and a second pin staked to the movable die member 52 or a longer pin passed entirely through the member to travel in the second slot. Additional scales can then be provided on the second jaw link for a total of up to four possible scales.

The third crimping surface 53 is at least generally planar and, preferably is essentially planar to avoid forming a sharp or even discernible concavity or convexity in the crimp made by that surface. As is best seen in FIG. 1, the third crimping surface 53 faces first and second crimping surfaces 26 and 36 and lies between those surfaces over all or at least substantially all of its range of travel towards and away from the apex 16. The three crimping surfaces 26, 36 and 53 all lie within a common plane, which is parallel to the plane of FIGS. 1 and 2, and together define in that plane a generally triangular crimp nest 18. Continuously variable positioning of th third crimping surface 53 with respect to first and second crimping surfaces 26 and 36 and apex 16, which is provided by means of the nut 54 and remainder of the movable die member 52, effectively provides continuously variable adjustment of the size of the crimp nest 18.

Use of the tool 10 is straightforward. The height of the movable die member 52 can be preadjusted using the indicator pin 58 and scale 59, if provided, or by trial and error with the tubular element to be crimped. The handles 50 and 60 are spread to spread as shown in FIG. 2 the first or working ends of the jaw members 20 and 30 to receive the tubular element to be crimped. The handles 60 and 70 are then brought together as shown in FIG. 1, closing the jaw members 20 and 30 and their respective first and second crimping surfaces 26 and 36 down on the tubular member. Surfaces 26 and 36 press the tubular member down on the third crimping surface 53. Preferably, the handles 60 and 70 are brought together sufficiently to pass the center of the fifth pivot 66 between the centers of the third and fourth pivots 28 and 38 to an over-center position indicated in FIG. 1. In the over-center position, the tool 10 has developed the maximum compressive forces it will develop given the location of the movable die member 52 and the orientation of lever arm 76. If the over-center position of the fifth pivot coupling 66 cannot be reached while attempting to crimp a given tubular element, the movable die member 52 can be adjusted to lie slightly farther away from the apex 14. Greater force can be developed by moving the third crimping surface 53 closer to the apex 14, resulting in a decrease in the crimp nest size, or by adjusting screw 78, if further reduction in the crimp nest size is not desired. To form a good crimp, the tubular element should be collapsed totally around the wire or other material received within the tubular element to form a substantially solid joint of the crimped tubular element and contained wire or other material. The tubular element should also be compressed sufficiently to cause plastic flow of the tubular element into the crimp, away from the crimped area or both.

The present invention is seen as having several distinct advantages over existing crimping tools. Tension tests have shown the triangular crimps developed by the present invention to be as strong as those of circular, square or hexagonal shape made by known symmetric-type tools. However, tools of the present invention have the advantage over symmetric type crimping tools in being more easily adjusted and continuously adjustable in crimp nest size. The present invention employs a movable die member with a relative large crimping surface (the third crimping surface 53), which is preferably comparable in area to the areas of the other crimping surfaces 26 and 36 to permit the generation of a substantially symmetric crimp. Unlike other symmetric crimp geometries, the triangular crimp geometry of the present invention permits a uniform and symmetric adjustment in a major proportion of the total crimp, namely that provided by the first and second crimping surfaces, when the crimp nest size is adjusted. The triangular configuration provides changes in each of these two sides of the crimp which are substantially uniform to one another and proportional to changes in the overall size of the nest. All other symmetric geometries require a substitution of dies or crimping surfaces to achieve proportional variations in a majority of the crimping surfaces when the area of the nest is varied.

Tools of the present invention can be provided in varying sizes and configurations to crimp tubular elements of different gauges and sizes. For example, the preferred embodiment tool 10 depicted in the figures is intended for two-handed operation with tubular elements sized to fit wire between about No. 8 and 4/0 American wire gage size. A proportionately smaller tool of the same components can also be provided to cover tubular elements designed to fit a range of insulated wire sizes from between about No. 18 to No. 1. Sizes above 4/0 American wire gage would require a larger tool head coupled with a hydraulic or electric drive or longer handles or handle, if bench mounted.

For the preferred tool 10 used with tubular elements sized for wire between about No. 8 and 4/0, the suggested length and width of each of the crimping surfaces 26 and 36 is about 0.7 inch and about 0.2 inch respectively, while the length and width of the third crimping surface is preferably about 0.4 inches and about 0.2 inches, respectively. The suggested distance from the centers of the first and second pivots 46 and 48 to the centers of the first and second crimping surfaces 26 and 36, respectively, are preferably about 2.3 inches. The center-to-center spacing between the first and second pivots 46 and 48 is preferably about 1.75 inches. With this configuration, the angle of each of the first and second crimping surfaces 26 and 36 to the bisector of the included angle 14 is preferably about forty-one degrees plus or minus about two to three degrees.

It has been found with this geometry in a typical crimping operation, that the first and second jaw members 20 and 30 initially compress a tubular element received in the nest down upon the third crimping surface 53 where the crimp is initiated. Inward deflection of the tubular element under the first and second crimping surfaces is generally not initiated, when the crimp nest is properly sized, until the first and second crimping surfaces are sufficiently close to one another to prevent a deflection of the tubular element between and above those surfaces and above the apex 16. The invention provides an "indent free" crimp, avoiding the generation of any indent dimple or concavity or other possibly objectionable configuration in the crimp.

From the foregoing description, it can be seen that the present invention comprises a crimping tool having advantages of both symmetric and movable die member type crimping tools which is simple in construction and easy to manufacture and use. While a preferred embodiment has been disclosed and some variations thereto suggested, it will be appreciated by those skilled in the art that other changes could be made to the embodiments described above without departing from the broad inventive concept. It should be understood, therefore, that this invention is not limited to the particular embodiment disclosed or arrangements suggested, but is intended to cover all modifications which are within the scope and spirit of the invention as defined by the appended claims.

I claim:

1. A tool for crimping tubular connector and terminal elements, the tool comprising:

a first jaw member having a pair of opposing ends and a first crimping surface proximal a first of the pair of ends;

a second jaw member having a pair of opposing ends and a second crimping surface proximal a first of the pair of ends;

pivot means supporting the first and second jaw members for pivoting movement with respect to one another in a common plane of the tool, and end of the first crimping surface adjoining an end of the second crimping surface and defining a generally concave recess in the common plane when the first ends of the first and second jaws are pivoted together;

a third, generally planar crimping surface located between the first and second jaw members in the common plane within the recess, the third surface facing and extending transversely with respect to both of the first and second crimping surfaces and defining a crimp nest with the first and second crimping surfaces when the first ends of the first and second jaws are pivoted together, the crimp nest further being open on at least opposing sides of the common plane so as to receive within the three crimping surfaces a tubular element having a longitudinal direction extending perpendicularly to the common plane said third crimping surface being stationary during pivoting movement of said first and second jaw members; and means for adjustably positioning the third crimping surface in the recess towards and away from the adjoining ends of the first and second crimping surfaces to selectively vary the size of the crimp nest defined at least when the first ends of the first and second jaw members are pivoted together.

2. The tool of claim 1 wherein the means for adjustably positioning is continuously adjustable for continuously variable positioning of the third crimping surface from the adjoining ends of the first and second crimping surfaces.

3. The tool of claim 2 further comprising:

indicator means coupled with the third crimping surface for moving with movement of the third crimping surface towards and away from the at least adjoining ends of the first and second crimping surfaces; and scale means adjoining the indicator means for measuring relative position of the third crimping surface.

4. The tool of claim 3 wherein the pivot means comprises:

a jaw link;

a first pivot on the jaw link pivotally supporting the first jaw member; and a second, separate pivot on the jaw link pivotally supporting the second jaw member, the first and second pivots being spaced apart from one another on the jaw link.

5. The tool of claim 4 wherein each of the first and second crimping surfaces is at least substantially planar and wherein the three planar crimping surfaces define sides of a generally triangular crimp nest.

6. The tool of claim 5 further comprising:

a first elongated handle;

a second elongated handle;

a third pivot pivotally coupling together one end of the first elongated handle and a remaining end of the first jaw member;

a fourth pivot pivotally coupling together an end of the second handle and a remaining end of the second jaw member; and a fifth pivot spaced from the third and fourth pivots and pivotally coupling together the first and second handles.

7. The tool of claim 1 wherein the pivot means comprises:

a jaw link;

a first pivot on the jaw link pivotally supporting the first jaw member; and a second, separate pivot on the jaw link pivotally supporting the second jaw member, the first and second pivots being spaced apart from one another on the jaw link.

8. The tool of claim 7 further comprising:

a first elongated handle;

a second elongated handle;

a third pivot coupling one end of the first elongated handle to a remaining end of the first jaw member;

a fourth pivot coupling an end of the second handle to a remaining end of the second jaw member; and fifth pivot spaced from the third and fourth pivots and coupling together the first and second handles.

9. The tool of claim 1 wherein the jaw members pivot in the common plane and wherein the adjoining ends of the first and second crimping surfaces abut one another when the first ends of the first and second jaw members are pivoted together to define a close ended concave recess.

10. The tool of claim 1 wherein the means for adjustably positioning the third crimping surface supports the third crimping surface within the concave recess defined by the first and second crimp surfaces when the ends of the first and second jaw members are pivoted together with one another.

11. The tool of claim 10 wherein the means for adjustably positioning the third crimping surface comprises a movable die member and an adjustment nut, the die member having a threaded shaft and a longitudinal end forming the third crimping surface and the adjustment nut threadingly receiving the threaded movable die member, the movable die member being supported on the adjustment nut and the adjustment nut being rotatably captured by the pivot means.

12. A tool for crimping tubular connector and terminal elements, the tool comprising:

a first jaw member having a pair of opposing ends and a first, generally planar crimping surface proximal a first of the pair of ends;

a second jaw member having a pair of opposing ends and a second, generally planar crimping surface proximal a first of the pair of ends;

pivot means supporting the first and second jaw members for pivoting movement with respect to one another in a common plane, the first and second crimping surfaces defining two generally straight sides of an acute included angle in the common plane, after the first and second jaw members have been pivoted together; and a third, generally planar crimping surface supported from the pivot means to lie between the first and second jaw members within the common plane, the third planar surface facing and being oriented transversely with respect to both the first and second crimping surfaces so as to define a three-sided, triangular-shaped crimp nest with the first and second crimping surfaces, the crimp nest being open at least on opposing sides of the common plane so as to receive within the three facing crimping surfaces a tubular element having a longitudinal direction extending perpendicularly to the common plane, the third crimping surface remaining stationary between and generally facing the first and second crimping surfaces, at least while the first and second jaw members are pivoting, and being selectively adjustable between the first and second crimping surfaces towards and away from the adjoining ends of the first and second crimping surfaces, at least after the first and second jaw members have been pivoted together, so as to permit selective variation of the size of the crimp nest defined by the three crimping surfaces.

13. The tool of claim 12 wherein the means for adjustably positioning is continuously adjustable for continuously variable positioning of the third crimping surface from the adjoining ends of the first and second crimping surfaces.

14. The tool of claim 13 further comprising:

indicator means coupled with the third crimping surface for moving with movement of the third crimping surface; and scale means adjoining the indicator means for measuring relative position of the third crimping surface with the indicator means.

15. The tool of claim 14 wherein the pivot means comprises:

a jaw link;

a first pivot on the jaw link pivotally supporting the first jaw member; and a second, separate pivot on the jaw link pivotally supporting the second jaw member, the first and second pivots being spaced apart from one another on the jaw link.

16. The tool of claim 15 further comprising:

a first elongated handle;

a second elongated handle;

a third pivot pivotally coupling together one end of the first elongated handle and a remaining end of the first jaw member;

a fourth pivot pivotally coupling together an end of the second handle and a remaining end of the second jaw member; and a fifth pivot spaced from the third and fourth pivots and pivotally coupling together the first and second handles.

17. The tool of claim 12 wherein the means for adjustably positioning the third crimping surface comprises a movable die member and an adjustment nut, the die member having a threaded shaft and a longitudinal end forming the third crimping surface and the adjustment nut threadingly receiving the threaded movable die member, the movable die member being supported on the adjustment nut and the adjustment nut being rotatably captured by the pivot means.

18. A tool for crimping tubular connector and terminal elements, the tool comprising:

a first jaw member having a pair of opposing ends and a first crimping surface proximal a first of the pair of ends;

a second jaw member having a pair of opposing ends and a second crimping surface proximal a first of the pair of ends, the first and second jaw members being supported for pivoting movement with respect to one another in a common plane of the tool and the first crimping surface and the second crimping surface defining a generally concave recess in the common plane after the first ends of the first and second jaws have been pivoted together;

a third crimping surface located between the first and second jaw members in the common plane, the third crimping surface facing and extending generally transversely with respect to both of the first and second crimping surfaces and defining a crimp nest with the first and second crimping surfaces after the first ends of the first and second jaw members have been pivoted together, the crimp nest further being open on at least opposing sides of the common plane so as to receive within the three crimping surfaces a tubular element having a longitudinal direction extending perpendicularly to the common plane, the third crimping surface remaining stationary operative position generally facing the first and second crimping surfaces, at least while the first and second jaw members are pivoting with respect to one another, and being selectively adjustable towards and away from the first and second crimping surfaces to permit selective variation of the size of the crimp nest defined, at least after the first ends of the first and second jaw members have been pivoted together.

19. The tool of claim 18 further comprising a coupling pivotally supporting the first and second jaw members and operatively supporting the third crimping surface against movement away from the first and second crimping surfaces at any selected stationary position of the third crimping surface.

* * * * *